United States Patent [19]

Verkasalo

[11] Patent Number: 4,675,487

[45] Date of Patent: Jun. 23, 1987

[54] APPARATUS AND METHOD FOR ELECTROMAGNETIC HEATING OF A ROLL

[75] Inventor: Matti Verkasalo, Jyväskylä , Finland

[73] Assignee: Valmet Oy, Finland

[21] Appl. No.: 732,821

[22] PCT Filed: Oct. 2, 1984

[86] PCT No.: PCT/FI84/00070

§ 371 Date: Apr. 29, 1985

§ 102(e) Date: Apr. 29, 1985

[87] PCT Pub. No.: WO85/01532

PCT Pub. Date: Apr. 11, 1985

[30] Foreign Application Priority Data

Oct. 3, 1983 [FI] Finland ..... 833589
Aug. 29, 1984 [FI] Finland ..... 843412

[51] Int. Cl.[4] ..... H05B 6/14

[52] U.S. Cl. ..... 219/10.43; 219/10.49 A; 219/10.61 A; 219/10.71; 219/10.77; 219/10.79; 219/471; 100/93 RP

[58] Field of Search ..... 219/10.49 A, 10.61 A, 219/10.61 R, 10.49 R, 10.77, 10.75, 469, 470, 471, 10.57, 10.79, 10.41, 10.43, 10.71; 100/38, 92, 93 RP

[56] References Cited

U.S. PATENT DOCUMENTS

| | | | |
|---|---|---|---|
| 2,525,842 | 8/1970 | Steinhoff et al. | 219/10.79 X |
| 2,761,941 | 9/1956 | Ardichvili | 219/10.61 A |
| 3,444,346 | 5/1969 | Russell et al. | 219/10.61 R |
| 3,702,912 | 11/1972 | Greenberger | 219/10.61 |
| 4,258,241 | 3/1981 | Soworowski | 219/10.43 X |
| 4,321,444 | 3/1982 | Davies | 219/10.71 X |
| 4,350,861 | 9/1982 | Pouillange et al. | 219/10.61 R |
| 4,384,514 | 5/1983 | Larive et al. | 219/10.71 X |
| 4,425,489 | 1/1984 | Pav et al. | 219/10.61 A X |
| 4,472,616 | 9/1984 | Maurice et al. | 219/10.43 |

FOREIGN PATENT DOCUMENTS

| | | |
|---|---|---|
| 0067786 | 12/1982 | European Pat. Off. . |
| 1237239 | 3/1967 | Fed. Rep. of Germany . |
| 949484 | 2/1964 | United Kingdom . |

*Primary Examiner*—Philip H. Leung
*Attorney, Agent, or Firm*—Steinberg & Raskin

[57] ABSTRACT

Apparatus and method for electromagnetic heating of a roll by induction, in which a variable magnetic flux is directed into an outer surface of the roll from a magnetic shoe device comprising a plurality of cores situated externally of the roll and over substantially the entire axial length thereof. Each core is spaced a discrete distance from the roll surface. The magnetic flux acts to induce eddy currents along the surface of the roll, thus generating heat thereon.

24 Claims, 7 Drawing Figures

APPARATUS AND METHOD FOR ELECTROMAGNETIC HEATING OF A ROLL

BACKGROUND OF THE INVENTION

The invention is concerned with a method for electromagnetic heating by induction heating of a roll, in particular of a calender roll, used in the manufacture of paper or of some other web-formed product, in which method a variable magnetic flux is directed at the mantle of the roll, free of contact, by the intermediate of a magnetic shoe device through air gaps, the said magnetic flux inducing eddy currents in the mantle of the roll, which said eddy currents generate heat owing to the resistance of the roll mantle.

A further subject of the present invention is a paper machine roll device intended for carrying out the method in accordance with the present invention, in particular for the calender of a paper machine, in which said roll device there is a roll mantle arranged as revolving around its central axis, a magnetizing device being arranged in the proximity of the outer face of the roll mantle, which said magnetizing device comprises a number of component cores as well as an electromagnetic coil or coils, by means of which the iron core is magnetized by means of AC electricity.

In respect of the prior art technology related to the invention, reference is made, by way of example, to U.S. Pat. Nos. 4,425,489 and 4,384,514, EP Publication No. 67786, and U.S. patent application Ser. No. 560,394. From U.S. Pat. No. 4,425,489, an electromagnetically heated calender roll is known in which several magnets have been fitted into blocks placed side by side in the axial direction and leaving at least the working area of the outer circumference free, whereat in each block or group of blocks the set value corresponding to the change in the magnetic flux in the mantle of the roll can be varied separately, and whereat, in the roll, at least one temperature measurement-value detector is used, which indicates the measurement value corresponding to the factual-value temperature of the outer face of the roll mantle at different positions placed axially apart from each other, and which said device comprises a control circuit system which changes the set values on the basis of the measurement values and of the predetermined temperature profile for the outer face of the roll mantle.

According to the U.S. patent application Ser. No. 560,394 (applicant Valmet Oy), U.S. Pat. No. 4,614,565 the calender roll is heated inductively by means of eddy currents, and the heating by means of eddy currents is directed on the surface layer of the roll only, made of a ferromagnetic material, and from outside the roll only. According to the said application, an annular thermal insulation layer has been made onto the roll frame, which layer is of a magnetically nonconductive material, and on top of the said layer there is the outer mantle of a ferromagnetic material, whose wall thickness is as little as possible from the point of view of mechanical loads. By means of this arrangement, attempts are made to direct the heating at the heating of the surface layer of the roll mantle only in order to improve the efficiency of heating and to accelerate the adjustment of the temperature profile. The arrangement in accordance with the said patent application is, however, mechanically quite difficult and expensive to accomplish.

SUMMARY OF THE INVENTION

One of objectives of the present invention is partly to reach the same goals as in U.S. patent application Ser. No. 560,394. A further objective of this invention is to provide a method and a device by means of which the heating effect can be adjusted in a controlled way and rapidly in the axial direction of the calender roll for the purpose of controlling the thickness profile and/or the surface properties of the web to be calendered.

As is well known, changes in the temperature profile of the calender roll affect the web to be calendered in two ways. Firstly, the temperature acts directly upon the surface properties of the web to be calendered, and secondly the diameter of the calender roll is changed to a certain extent as a function of the temperature, and these variations in the diameter, of course, act upon the pressure profile of the calendering nip and thereby upon the thickness profile of the web to be calendered.

A further objective of the invention is to provide such an inductive heating method of the sort concerned and such a method for adjustment of the temperature profile of the roll in which the transfer of power to the calender roll has an improved efficiency (overall efficiency).

A further objective of the invention is to provide a said heating method in connection with which it is possible to apply such closed systems of adjustment of the temperature profile in which the profile in which the problems of stability have been solved better than in prior art.

A further objective of the invention is to provide such a method for the adjustment of the temperature profile in which, instead of adjustment of the positions of adjoining cores or component cores of induction coils and instead of adjustment of the air gap, or together with these adjustments, it is possible to use an advantageous novel mode of controlling the heating power.

In order to achieve the objectives given above and those that will come out later, the invention is mainly characterized in that the said magnetic flux is applied to the roll mantle by means of a magnetic shoe device which comprises several component cores side by side, that the magnitude of the air gap $\Delta$ between the said component cores and the face of the roll mantle and/or the magnetizing current or currents of the component cores are adjusted so as to control the distribution of the heating effect in the axial direction of the roll, and that in the said heating, as the frequency of the magnetizing current of the component cores, such a high frequency is used that a sufficiently low depth of penetration of the heating effect is obtained (formula 3).

A particularly advantageous embodiment of the invention is characterized in that, in the method, the induction coil that performs the heating, or separate induction coils, are connected together with a parallel and/or series capacitor to make a resonance circuit, and that, in the method, the frequency to be supplied into the said resonance circuit or circuits has been chosen above or below the resonance frequency or frequencies of the said resonance circuit or circuits at an appropriate safety distance from the said resonance frequency or frequencies.

In the embodiment of the invention defined in the preceding paragraph, particular attention is directed at the way in which the power source and the induction coil or group of coils in connection with the roll are fitted relative each other and at the way in which the electrotechnical parameters effective in connection with this arrangement have been chosen optimally both in respect of the efficiency of the power input and in respect of the control-technical problems of stability.

On the other hand, the device in accordance with the invention is mainly characterized in that the component cores of the magnetizing device are, each of them separately, arranged so that their positions in the radial plane of the roll can be adjusted for the purpose of adjustment of the magnitude of the air gap between the component cores and the outer face of the roll mantle located at the proximity of their front faces and, by that means, for the purpose of total or partial controlling of the heating effect in the axial direction of the roll, and that the device additionally comprises electricity supply means, by which the said magnetizing coil or coils are supplied with electricity of an appropriate constant or variable frequency or frequencies.

BRIEF DESCRIPTION OF THE DRAWING

In the following, the invention will be described in detail with reference to the certain exemplifying embodiments of the invention, illustrated in the figures of the attached drawing, the invention being not confined to the details of the said examples.

DESCRIPTION OF THE PREFERRED EMBODIMENT

Figure 3:
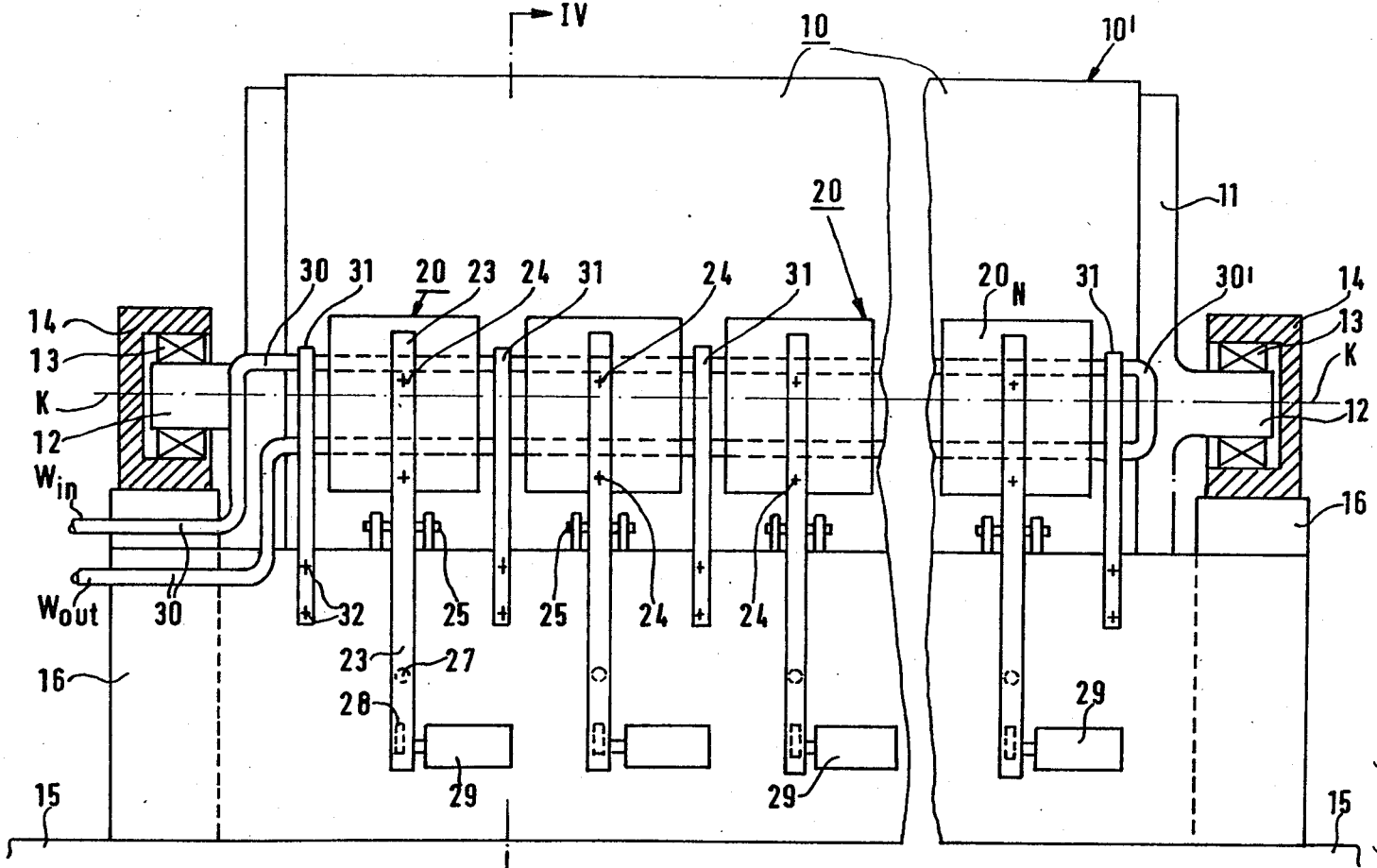
FIG. 3 is a more detailed view of the exemplifying embodiment corresponding to FIG. 2, as viewed in the machine direction.
Figure 4:
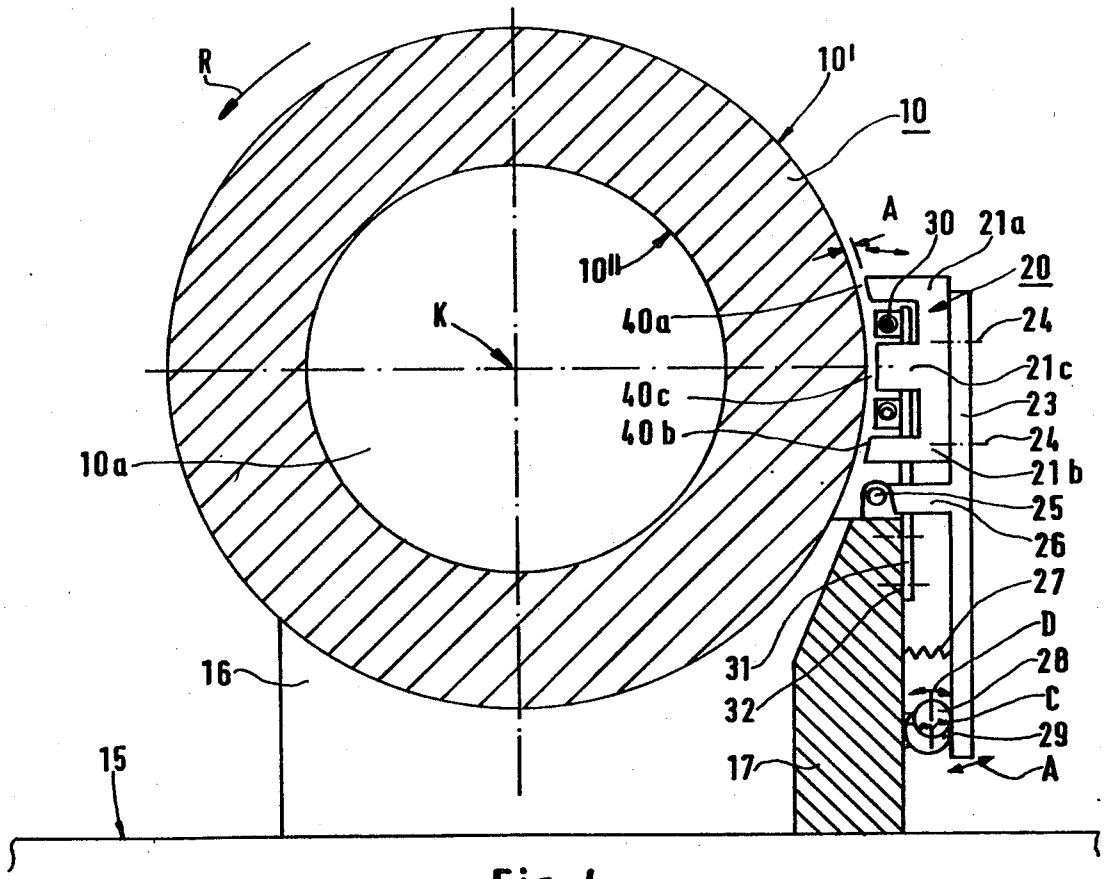
FIG. 4 is a sectional view at V—V in FIG. 3.

The calender roll 10 shown in FIGS. 1,2,3 and 4 is a roll either of a machine stack or of a supercalender. The roll 10 is, in a way in itself known, a part of a calender stack consisting of calender rolls. The roll 10 is provided with a smooth and hard face, and, in the way shown in FIG. 4, it has a cylindrical mantle, which is made of an appropriate ferromagnetic material, which has been chosen in view of the strength properites of the roll and the inductive and electromagnetic heating in accordance with the invention. The roll 10 is journalled as revolving around its centre axis K—K by means of its ends 11 and its axle journals 12. The axle journals 12 are provided with bearings 13, which are fitted in bearing housings 14. The bearing housings are fixed to the support frame 16 of the roll, which frame rests on a base 15. In FIGS. 3 and 4, the roll 10 is the lowermost roll in the calender stack, and, in a way in itself known, it forms a calendering nip with the counter-roll (not shown), whereat the paper or board web (not shown) to be calendered passes through the said nip.

In the interior space 10*a* of the roll 10 shown in FIG. 4, it is possible to accomodate the, in themselves known, devices of variable or adjustable crown, for which an abundant space is allowed owing to the invention, because, in the interior 10*a* of the roll 10, it is not necessary to use heating equipment operating by means of a liquid medium or equivalent, whereat the use of such heating equipment in connection with the present invention is, however, not excluded.

Figure 1:
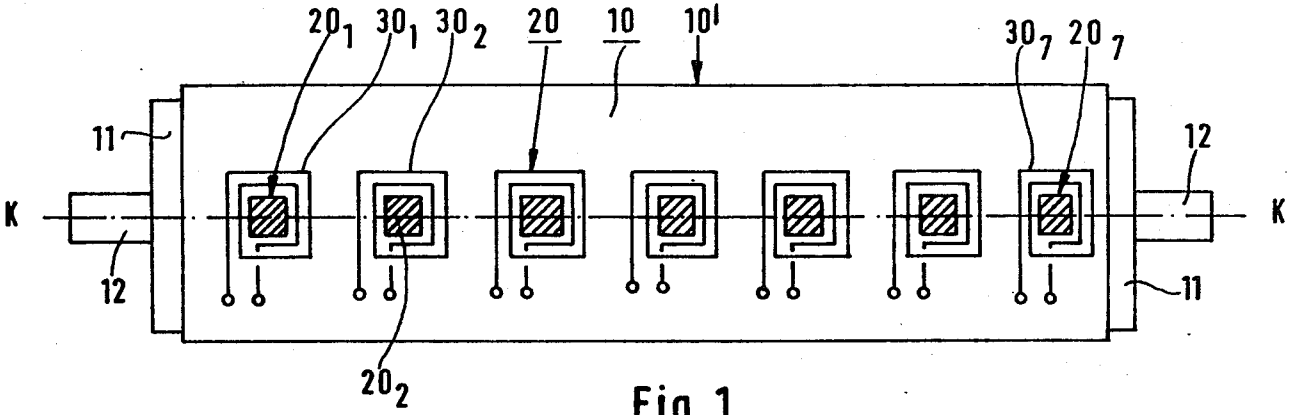
FIG. 1 is a schematical illustration of a first exemplifying embodiment of the heating device in accordance with the invention.
Figure 2:
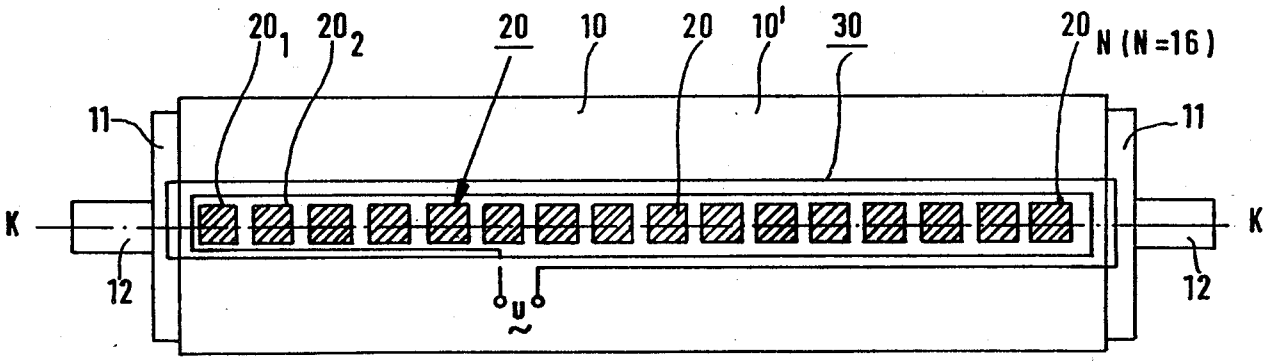
FIG. 2 is a schematical illustration of a second exemplifying embodiment of the heating device in accordance with the invention.

The roll 10 is arranged so as to be heated, in accordance with the invention, inductively and electromagnetically by means of eddy currents so that the temperature of the face of the mantle 10' of the roll 10 is, owing to this heating, raised to a considerably high level, as a rule about 70° C. to 100° C. In order to accomplish inductive heating, at one side of the roll, in the same horizontal line with each other, component cores $\mathbf{20}_1$, $\mathbf{20}_2 \ldots \mathbf{20}_N$ of the iron core have been arranged. These component cores constitute a magnetic shoe device 20, which additionally comprises a magnetizing coil 30, or for each component core a coil of its own $\mathbf{30}_1 \ldots \mathbf{30}_N$ (FIG. 1). As is seen from FIG. 4, the inductive heating is performed free of contact so that a little air gap 40*a*, 40*b*, 40*c* (Δ) remains between the face of the roll 10 mantle 10', through which gap the magnetic fluxes of the iron core are closed through the roll 10 mantle 10', causing the heating effect therein.

FIG. 1 shows a magnetizing coil $\mathbf{30}_1 \ldots \mathbf{30}_7$ of its own for each component core $\mathbf{20}_1 \ldots \mathbf{20}_N$. A second advantageous embodiment of the invention is in accordance with FIG. 2, wherein all the component cores $\mathbf{20}_1$ to $\mathbf{20}_N$ (N=16) have a common magnetizing coil 30, which in accordance with FIG. 2, has two windings. The coil 30 may have from one to five windings.

According to FIGS. 3 and 4, the magnetizing coil 30 of the iron core 20 has one winding only, which can usually be accomplished most advantageously both mechanically and electrically. According to FIGS. 3 and 4, the component cores $\mathbf{20}_1 \ldots \mathbf{20}_N$ are in the projection of FIG. 4, E-shaped, and they have side branches 21*a*, 21*b*, and the middle branch 21*c*, between which there remain grooves for the magnetizing coil 30.

According to the invention, each component core separately has been arranged so as to be displaceable in the radial plane of the roll 10 for the purpose of adjustment of the magnitude of the air gap Δ and, at the same time, of the heating output. For this purpose, each component core has been attached by means of screws 24 to vertical arms 23, which are, by the intermediate of horizontal arms 26, linked by means of the shaft 25 to the side flange 17 of the frame 16. An eccentric cam 28 has been attached to the lower end of the vertical arm 23, which said cam can be turned around the shaft C by means of a stepping motor 29 (arrow D in FIG. 4) so that the arm 23 pivots around its link shaft 25 (arrow A in FIG. 4), whereby the air gap is changed. As a rule, the air gap A may vary, e.g., within the range of 1 to 100 mm, preferably within the range of 1 to 30 mm. The displacement of the component cores may, of course, also be arranged by means of other mechanisms.

One important feature of the equipment embodiment in accordance with FIGS. 3 and 4 is that the single-turn magnetizing coil 30 or loop has been fitted stationarily on its support arms 31. The arms 31 are attached to the end 17 of the frame by means of screws 32. The parallel branches of the coil 30 are supported on the said arms 31, of an electrically insulating material, e.g., teflon, and with a sufficient play in the grooves between the branches 21*a*, 21*b* and 21*c* of the magnetic core so that, even though the coil 30 is stationary, the positions of the component cores of the iron core can be adjusted in accordance with the invention.

In FIG. 3, the end of the coil 30 is denoted with the reference numeral 30'. The coil or magnetizing loop 30 is made of a copper pipe of sufficient sectional area, through which pipe the circulation of the cooling water has been arranged, being illustrated in FIG. 3 by means of arrows $W_{in}$ and $W_{out}$. The use of a copper pipe is also advantageous in the respect that, when relatively high frequencies are used in accordance with the invention, the magnetizing current is concentrated at the outer circumference of the pipe and especially at the side of the pipe that is facing the calender roll, and thereby the conductive material is utilized more efficiently. The wall thickness of the said copper pipe is, e.g., about 1 mm.

FIG. 4 shows draw springs 27 attached to the vertical arms 23, which springs keep the component cores steadily in position and the dimension Δ of the air gap stable. The stepping motor 29 and the eccentric cam 28 are arranged so that the component cores $\mathbf{20}_n$ cannot reach contact with the face 10' of the roll 10 at any stage.

In respect of the electrotechnical background of the invention, the following is stated. When a varying magnetic field is arranged into an electrically conductive material, eddy current and hysteresis losses are generated in the material, and the material becomes warm. The power (P) of the eddy currents depends on the intensity (B) of the magnetic field and on the frequency (f) of change in the magnetic field, as follows:

$$p=B^{1.54}.f^{0.5} \quad (1)$$

The varying magnetic field generated on the roll 30 is closed between the front face of the iron core and the air gaps 40*a*,40*b* and 40*c* through the mantle of the roll 10. This magnetic field induces eddy currents into the surface layer of the roll mantle 10, which currents produce heat owing to the high resistance of the roll mantle 10. The distribution of the eddy currents, induced in the mantle 10, in the direction x of the radius of the roll follows the law:

$$I_x=I_o e^{-x/\delta} \quad (2)$$

wherein $I_x$ is the current density at the depth x from the mantle face 10' of the roll, $I_o$ is the current density at the face 10' of the roll 10, and δ is the depth of penetration. The depth of penetration has been defined as the depth at which the current density has been lowered to 1/e of the current density $I_o$ of the surface. For the depth of penetration, the following equation is obtained:

$$\delta = \frac{1}{2\pi}\sqrt{\frac{10^7\rho}{f\mu}\ \frac{m}{\Omega s}} \quad (3)$$

wherein ρ is the specific resistance of the material, f is the frequency of the magnetizing current, and μ is the relative permeability of the material.

The formula indicates that when the frequency is increased, the depth of penetration is reduced. When steel is heated, both the electrical conductivity and the permeability decrease with an increase in temperature. The permeability is assumed to remain constant up to Curie temperature.

As a rule, heating powers of the order of 4.3 to 8.4 $kW/m^2$ are used in the invention. As is well known, the smaller the air gap Δ is, the larger is the proportion of the electricity power passed into the device via the coil 30, that is transferred into the roll mantle 10 to be heated.

Figure 5:
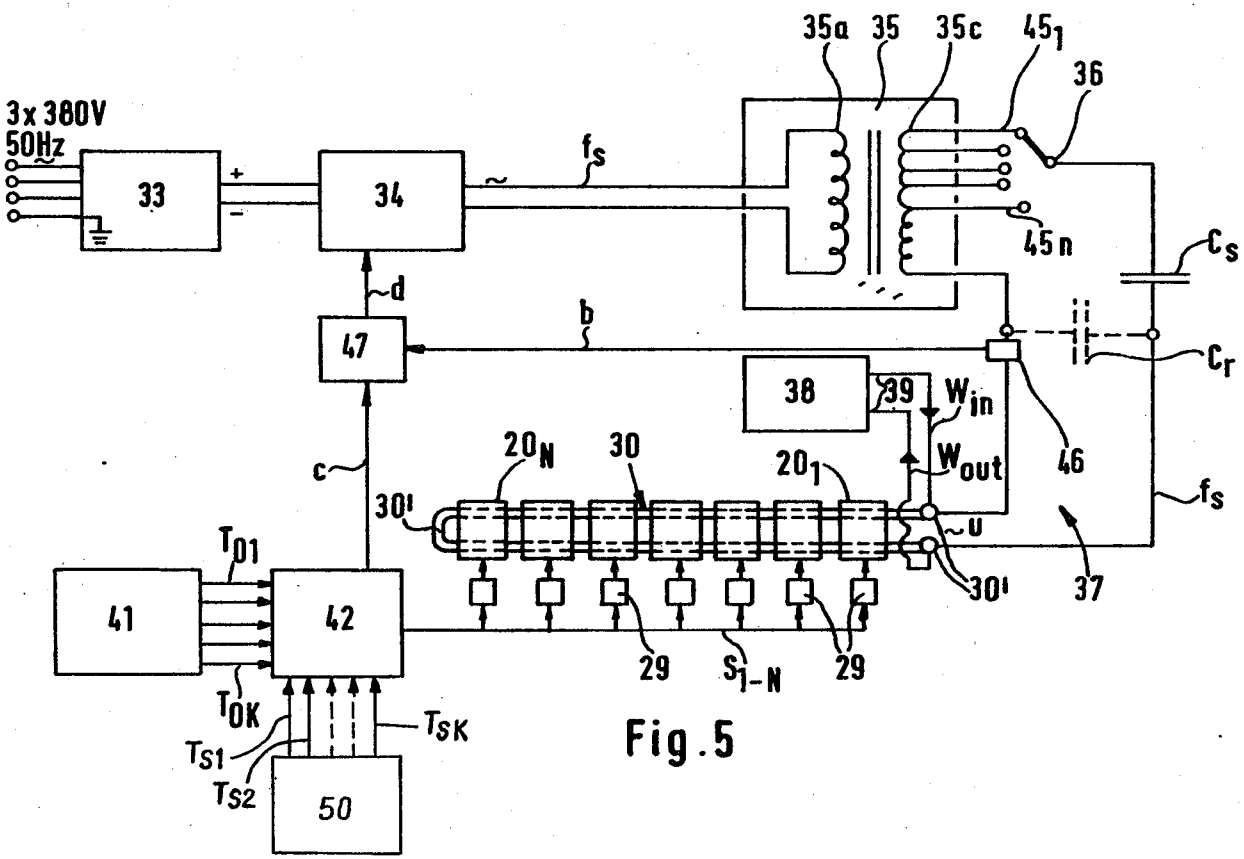
FIG. 5 shows the electricity supply component of the heating device in accordance with the invention as well as the control system that may belong to the device, substantially as a block diagram.

FIG. 5 shows a block diagram of the arrangement and electricity supply in accordance with the invention. The power is taken out of a 50 Hz three-phase network (3×380 V). By means of a rectifier 33, the AC current is converted to DC electricity, which is converted by means of an inverter 34 in itself known, based on power electronics, so that its frequency becomes suitable for the purposes of the invention. The f that is applicable in the invention is within the range of about 0.5 to 50 kHz, preferably about 1 to 30 kHz. This power, which is to be characterized as medium frequency in induction heating, is passed through a matching transformer 35 and a capacitor $C_s$ to the circuit 37, by means of which the magnetizing coil 30 is supplied. The voltage U at the poles 30'' of the coil 30 is, as a rule, within the range of U=800 to 1200 V. When series capacitors are used, one half of the capacitance of the capacitors can be located at one end of the roll, whereat the voltage is reduced to one half, i.e. 400 to 600 V. Cooling water is passed into the coil 30 and possibly into connection with the circuit 37, the equipment of supply of the said water being illustrated in FIG. 3 by the block 38 and by the feed pipes 39.

The adjustment of the positions of the component cores $\mathbf{20}_1 \ldots \mathbf{20}_N$ of the iron core 20 may, but does not have to, be accomplished by means of an automatic closed control system, which is shown schematically in FIG. 5. The adjusting motors consists of the stepping motors 29 mentioned above, which receive their adjusting signals $S_{1-N}$ from the block 42. The block 42 is controlled by a detector unit 41, which is, e.g., a temperature measurement arrangement by means of which the factual values of the surface temperatures $T_{ol} \ldots T_{ok}$ of the roll are measured at several different points in the axial direction K—K of the roll 10, and/or, if the roll 10 is used for thickness calibration, a series of measurement signals illustrating the thickness profile of the web to be calibrated. The block 42 may include a set-value unit 50, by means of which the temperature profile $T_{s1}, T_{s2}, \ldots T_{sk}$ in the axial K—K direction of the roll 10 is preset as desired at each particular time.

Figure 7:
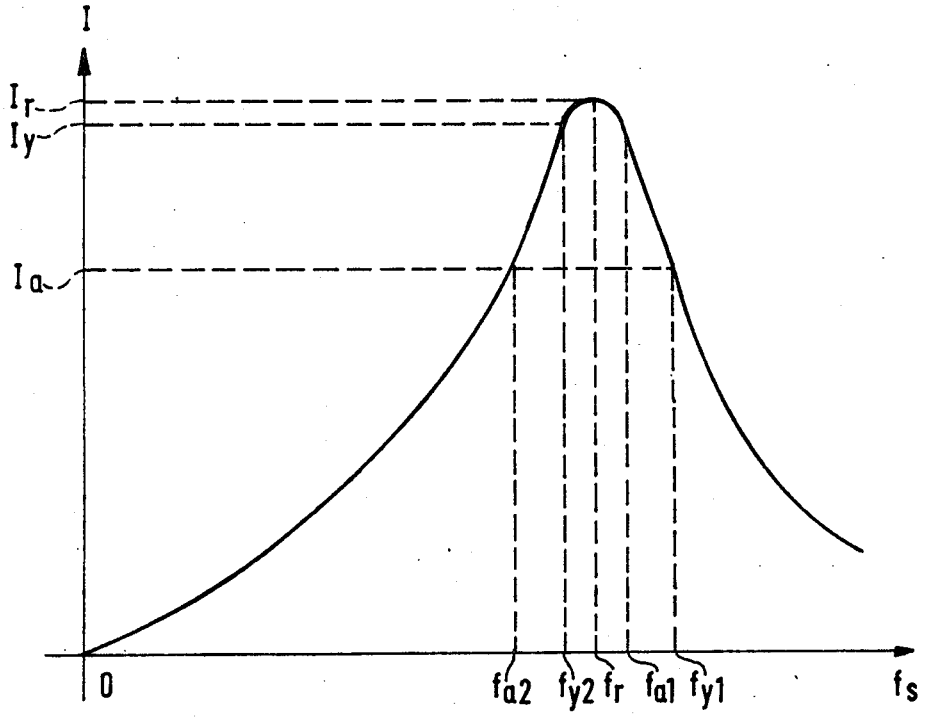
FIG. 7 shows the current in the resonance circuit used in the invention, as a function of the frequency.

In accordance with FIG. 5, the power of the inverter 34 is supplied through the matching transformer 35 into a LC resonance circuit in accordance with the invention, whose effect and operation are illustrated by FIG. 7. The transformer 35 comprises, in a way in itself known, a primary circuit 35*a*, an iron core 35*b*, and a secondary circuit 35*c*. The secondary circuit includes n pieces of tapping points $\mathbf{45}_l \ldots \mathbf{45}_n$, which can be connected via a change-over switch 36 to the resonance circuit 37, by means of which the power is supplied into the induction coil 30. As is well known, the resonance frequency of a RLC circuit connected in series can be calculated from the formula:

$$f_r = \frac{1}{2\pi\sqrt{LC}} \quad (4)$$

FIG. 7 illustrates the dependence of the current I in the circuit 37 from the frequency $f_s$. In resonance, the current $I_r = U/R$, , wherein in R is the resistance of the circuit 37. In FIG. 7 it has been assumed that the voltage U is invariable.

The efficiency of the transfer of the heating power is at its optimum when the operation takes place at the resonance frequency $f_r$. This advantageous embodiment of the invention is based thereon that, out of several reasons, it is not optimal to operate at the resonance frequency $f_r$ and/or, at the same time, at both sides of same, but the operating frequency is chosen either within the range of $f_{al}$ to $f_{yl}$ above the resonance frequency $f_r$ or, correspondingly, within the range of $f_{a2}$ to $f_{y2}$ below the resonance frequency $f_r$. Within the scope of the invention, the said ranges of frequencies are chosen preferably as follows: $f_{ai} \ldots f_{yl} = (1.01 \ldots 1.15) \times f_r$ or $f_{a2} \ldots f_{y2} = (0.85 \ldots 0.99) \times f_r$.

In accordance with FIG. 5, a series capacitor $C_s$ has been used in the RLC circuit. The circuit 37 is basetuned so that the transformation ratio of the transformer 35 is chosen on the switch 36 so that the resonance frequency $f_r$ calculated from the formula (4) assumes the correct position in accordance with the principles indicated above.

FIG. 5 shows, by means of broken lines, a parallel capacitor $C_r$, which may be used instead of, or besides, the series capacitor $C_s$. As is well known, the resonance frequency fr in a parallel resonance circuit, whose induction coil (L) has a resistance R, is calculated as follows:

$$f_r = \frac{1}{2\pi\sqrt{LC}} \sqrt{1 - \frac{R^2C}{L}} \tag{5}$$

In the above equation, (5) is a coefficient dependent on the resistance R.

However, from the point of view of the objectives of the invention, as a rule, a series resonance circuit is preferable, in particular in view of adjustment and control.

Within the scope of the invention, the resonance frequency is chosen preferably within the range of $f_r = 2 \ldots 35$ kHz. The frequency range of $f_r = 20 \ldots 30$ kHz has been noticed be particularly advantageous, this range being also advantageous in the respect that it is appropriately above the upper limit frequency of human hearing, so that, for this part, the problems of noise are also avoided.

Depending on the dimensioning of the coil cores 20 and on the air gap Δ between the roll 10 and the cores $\mathbf{20}_n$, the inductance of the resonance circuit is, e.g. with a roll 10 of a length of 8 meters, of the order of 10 to 250 μH. For example, if L=60 μpH and $f_r$=20 kHz, the value of the capacitance of the capacitor is obtained as $C_s$=1.06 μF.

According to a preferred embodiment of the present invention, in order to keep the efficiency of the power supply high and to eliminate phenomena of instability, i.e. the "risk of runaway", the operating frequency $f_s$ is arranged as automatically adjusted in accordance with the impedance of the resonance circuit 37 so that the operating frequency $f_s$ remains near the resonance frequency $f_r$ but, yet, at a safe distance from it, in view of the risk of runaway, i.e. within the ranges shown in FIG. 7, $f_{y1} \ldots f_{a1}$ or $f_{y2} \ldots f_{a2}$.

The measurement of the impedance of the resonance circuit 37 may be based, e.g., on the measurement of the current I passing in the circuit. This mode of measurement is illustrated in FIG. 5 by block 46, from which the control signal b is passed to the control unit 47, which changes the frequency $f_s$ of the frequency converter 34 on the basis of the control signal b. Another mode of measurement of the said impedance, to be used as an alternative or in addition to the current measurement, is deriving the control signal c from the block 42, from which the information can be obtained on the position of the component cores $\mathbf{20}_n$, i.e. on the air gaps A, which primarily determine the said impedance by acting upon the inductance L. An alternative mode of adjustment is to pass the return signal from the stepping motors 29 to the block 47 and further so as to act upon the output frequency $f_s$ of the frequency converter 34.

Figure 6:
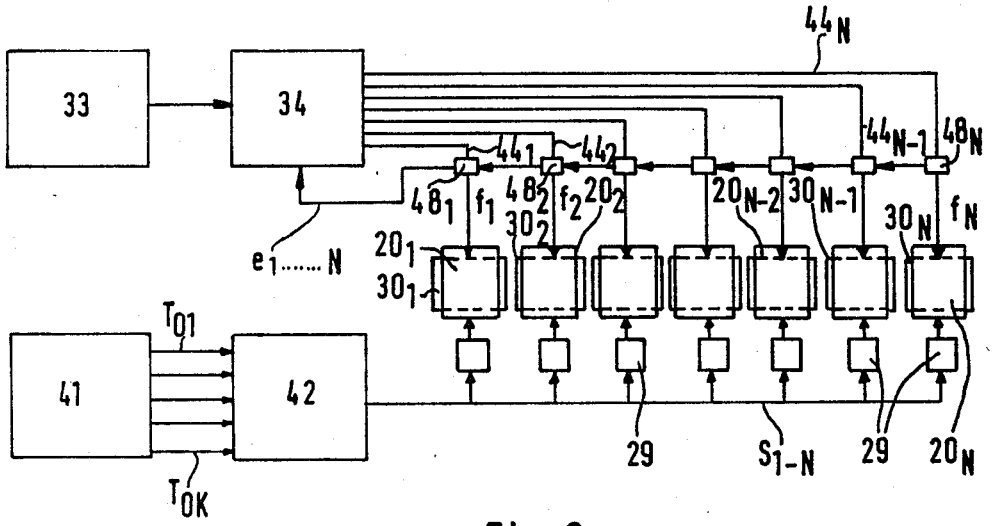
FIG. 6 illustrates such an exemplifying embodiment of the invention as is based on the embodiment shown in FIG. 1 and in which, instead of, or in connection with, adjustment of the air gap, the novel mode of adjustment of the heating power in accordance with the invention is used.

FIG. 6 shows an alternative embodiment of the invention, in which each component core $\mathbf{20}_n$ is provided with an induction coil of its own, in accordance with FIG. 1. To each component core $\mathbf{20}_n$, a separately adjustable frequency $f_l \ldots f_N$ of its own is passed from the frequency converter 34 by means of the supply conductor $\mathbf{44}_l \ldots \mathbf{44}_N$. When the air gap of each component core 20 is now adjusted by means of the stepping motors 29, the resonance frequency $f_r$ of each separate resonance circuit is changed. The measurement of the impedance of each separate resonance circuit is performed by means of separate current meters $\mathbf{48}_l \ldots \mathbf{48}_N$, and the series of signals $e_l \ldots e_N$ obtained from the said meters and including the information, e.g., on the magnitudes of the air gaps A of the various component cores is used for controlling the frequency converter unit 34 or group. Thereby each frequency $f_l \ldots f_N$ is changed to a level optimal in view of the efficiency of the power supply of the component core and in view of the stability of the adjustment.

By means of a circuit similar to FIG. 6, within the scope of the invention, it is also possible to accomplish a different power adjustment even so that the component cores $\mathbf{20}_1 \ldots \mathbf{20}_N$ either can be made static or the adjustment of their air gaps Δ can be arranged so that it is similar to an adjustment of a basic setting and not an operational adjustment proper. In such a case, by changing each frequency $f_l \ldots f_N$ individually, on the basis of FIG. 7 it is possible to act upon the current I supplied into the circuit and thereby upon the heating power of the different component cores $\mathbf{20}_n$ and thereby upon the temperature profile of the roll 10. If the operation takes place within the above frequency ranges below or above the resonance frequency $f_r$, by changing the supply frequencies $f_l \ldots f_N$ it is possible to act upon the current I within the range $I_y \ldots I_a$. The strength B of the magnetic field (formula (1)) depends substantially proportionally on the magnetizing current. The steepness of the specific curve of this adjustment is the higher, the sharper is the quality factor $Q_s$ of the resonance circuit 37: $Q_s = (L/C)/R$. It is an advantage of this mode of adjustment that the interdependence between the frequency $f_s$ and the current I at both sides of the resonance frequency $f_r$ of the resonance circuit is, within the frequency ranges used, quite linear, and, moreover, this interdependence can be set at the desired level by acting upon the quality factor $Q_s$ mentioned above.

The novel mode of adjustment based on changing the frequency, described above, can be used either alone for adjustment of the temperature profile of the roll 10 or, in addition to, and besides, the adjustment of the air gap, for improving the accuracy and/or speed of the adjustment.

In certain cases, by using the mode of adjustment based on changing the frequency, described above, complete omission of mechanical adjustment means acting upon the air gap is possible. In this way, the speed of the adjustment system can be increased and, in certain cases, the accuracy of the adjustment be improved, even though thereat it may be necessary to sacrifice some of the efficiency of the power supply. With the aid of the control mode described above it is also possible to adjust the desired total power by means of the rectifier. By passing the feedback signal to the rectifier from the coil current, a constant coil current can be maintained also by the rectifier. In spite of this, the system can comprise the "optimum" control of the frequency described above.

The various details of the invention may show variation within the scope of the inventive idea.

I claim

1. Apparatus for electromagnetic heating of a roll by induction to affect the properties of a web passing through a nip formed in part by the roll, comprising electromagnetic means for inducing eddy currents in the roll, and situated externally of the roll, and extending over substantially the entire axial length thereof, said electromagnetic means comprising a plurality of cores, each core being spaced a respective distance from the surface of the roll, means for adjusting said distance by which each core is spaced from the roll surface independently of said distances by which said other cores are spaced from the roll surface, whereby the temperature profile over the axial length of the roll can be controlled, means for supplying magnetizing current to said electromagnetic means, and means for adjusting frequency of said supplied magnetizing current, to thereby control depth of penetration of the heat into the roll below the surface thereof, wherein said electromagnetic means additionally comprise at least one magnetizing coil disposed about said cores and connected with said current supplying means, and wherein said distance adjusting means comprise a support arm affixed to each said core, shaft means disposed on a frame of said apparatus, each support arm being pivotally mounted upon said shaft means, and motor means for adjusting position of said support arms and thereby adjusting position of said cores, said motor means being constituted by a plurality of eccentric cams, each eccentric cam rotatably contacting a respective support arm, and a plurality of stepping motors, each motor engaged with and adapted to rotate a respective cam.

2. The apparatus of claim 1, wherein a single coil is disposed about all of said cores.

3. The apparatus of claim 2, wherein said coil is in the form of a hollow pipe, and additionally comprising means for conducting cooling fluid through said hollow pipe.

4. The apparatus of claim 1, wherein a separate coil is disposed about each of said cores.

5. The apparatus of claim 1, wherein each of said cores is substantially E-shaped with a middle and outer branches defining grooves therebetween, and said coil being situated in said defined grooves.

6. The apparatus of claim 5, wherein said coil is substantially stationarily mounted within said grooves by at least one second support arm being mounted on the frame, such that position of said coil is independent of the adjustment of positions of said cores.

7. The apparatus of claim 1, additionally comprising means for detecting temperture profile in at least one of the axial and radial directions of said roll, and connected with said adjusting means, with position of said cores being adjusted in response to detected temperature.

8. The apparatus of claim 7, additionally comprising means for pre-setting the axial temperature profile of said roll, and connected with said adjusting means, with position of said cores being adjusted in response to the pre-set temperature profile.

9. Method of electromagnetic heating of a roll by induction to affect the properties of a web passing through a nip formed in part by the roll, comprising the steps of directing a variable magnetic flux into an outer surface of the roll from a magnetic shoe device comprising a plurality of cores situated externally of the roll over substantially the entire axial length thereof, each core being spaced a respective distance from the roll surface, said magnetic flux acting to induce eddy currents along the surface of the roll, and generating heat thereon, adjusting the magnitude of the distance by which each core is spaced from the roll surface independently of the distances by which the other cores are spaced from the roll surface to control the temperature profile over the axial length of the roll, and providing magnetizing current with a high frequency to ensure a low depth of penetration of the heat effect below the surface of the roll, wherein the magnetizing current is provided through a resonance circuit, and with a frequency above or below resonance frequency and at a safe distance therefrom, additionally comprising measuring impedance of the resonance circuit, and adjusting the provided frequency in response to the measured impedance.

10. The method of claim 9, wherein said distances are adjusted between 1 to 100 mm.

11. The method of claim 10, wherein said distances are adjusted between 1 to 30 mm.

12. The method of claim 9, additionally comprising adjusting the frequency of the current between 0.5 and 50 kHz.

13. The method of claim 12, wherein the frequency is adjusted between 1 to 30 kHz.

14. The method of claim 9, wherein said magnetizing current is provided through a common coil disposed about all said cores with from 1 to 5 windings.

15. The method of claim 9, wherein said magnetizing current is provided through a separate coil disposed about each of said cores.

16. The method of claim 15, additionally comprising adjusting frequency of current supplied to each core through each of said coils.

17. The method of claim 9, additionally comprising adjusting the provided frequency based upon magnitude of the distance between the roll and each component core.

18. The method of claim 9, wherein the current is supplied through at least one frequency converter into at least one matching transformer, with said resonance circuit being connected to at least one secondary winding of said transformer.

19. The method of claim 18, additionally comprising setting at least one of the resonance frequency and supply voltage, by connecting said resonance circuit with tapping points on the secondary winding of said transformer through a change-over switch.

20. The method of claim 9, wherein the provided frequency is chosen above the resonance frequency, $f_r$, within the range of 1.01 $f_r$ and 1.15 $f_r$, or below the resonance frequency $f_r$ within the range of 0.85 $f_r$ and 0.99 $f_r$.

21. The method of claim 20, additionally comprising choosing the resonance frequency between 2 and 35 kHz.

22. The method of claim 21, wherein the resonance frequency is chosen between 20 and 30 kHz.

23. The method of claim 9, additionally comprising setting inductance of the resonance circuit between 10 and 250 $\mu$H.

24. Apparatus for electromagnetic heating of a roll by induction to affect the properties of a web passing through a nip formed in part by the roll, comprising electromagnetic means for inducing eddy currents in the roll, and situated externally of the roll, and extending over substantially the entire axial length thereof, said electromagnetic means comprising a plurality of cores, each core being spaced a respective distance from the surface of the roll, means for adjusting said distance by which each core is spaced from the roll surface independently of the distances in which the other cores are spaced from the roll surface, whereby the temperature profile over the axial length of the roll can be controlled, means for supplying magnetizing current to said electromagnetic means, and means for adjusting frequency of said supplied magnetizing current, to thereby control depth of penetration of the heat into the roll below the surface thereof, wherein said electromagnetic means additionally comprise at least one magnetizing coil disposed about said cores and connected with said current supplying means, and said distance adjusting means comprise a support arm affixed to each said core, shaft means disposed on a frame of said apparatus, each support arm being pivotably mounted upon said shaft means, and motor means for adjusting position of said support arms and thereby adjusting position of said cores, said motor means comprising a plurality of motors, each motor being engaged with a respective support arm and adapted to rotate the same about said shaft means.

* * * * *